US006149339A

United States Patent [19]

Salloum et al.

[11] Patent Number: 6,149,339

[45] Date of Patent: Nov. 21, 2000

[54] FOLDABLE ROAD MARKER

[76] Inventors: James Sinclair Salloum, 1028 Bonita Dr., Pensacola, Fla. 32507; Wilburn Alden White, 2695 Beacon Hill, Apt. 311, Auburn Hills, Mich. 48326; David Alden White, 1292 Hampton Rd., Grosse Pointe Woods, Mich. 48236; Edward Cullin Smith, 33071 Karin Dr., Apt. 10, Sterling Heights, Mich. 48310; John Quinn Nelson, 13029 Sidonie St., Warren, Mich. 48089

[21] Appl. No.: 09/317,246

[22] Filed: May 24, 1999

[51] Int. Cl.[7] ..... E01F 9/00; E01F 13/00; E01F 15/00

[52] U.S. Cl. ..... 404/6; 404/9; 404/10; 116/63 P; 116/63 R

[58] Field of Search ..... 404/6, 9, 10, 12; 116/63 P, 63 R, 63 C

[56] References Cited

U.S. PATENT DOCUMENTS

| | | | |
|---|---|---|---|
| 3,911,854 | 10/1975 | Manuel | 116/63 P |
| 4,792,258 | 12/1988 | Goff | 404/6 |
| 4,973,190 | 11/1990 | Erwin et al. | 404/10 |
| 5,030,029 | 7/1991 | Johnsen | 404/6 |
| 5,168,827 | 12/1992 | Junker | 116/63 P |
| 5,287,822 | 2/1994 | Anderson | 116/63 P |

*Primary Examiner*—Eileen D. Lillis
*Assistant Examiner*—Gary S. Hartmann
*Attorney, Agent, or Firm*—Bernard J. Cantor; Harness, Dickey & Pierce

[57] ABSTRACT

A foldable road marker is formed of a pair of panels each having a central stem portion integrally connected with side panel portions. The panels each having an elongated slot with the stem portion and slots being coaxial. Each stem portion is fitted within the slot of the opposite panel for interconnecting the panels. The panels are pivotable relative to each other into a position in which they are transverse to each other or, alternatively, into a folded position in which they are generally parallel and closely overlap to each other for storage. Guide members are formed in the slots of each of the panels for slideably fitting within vertically arranged guide channels formed in the stem portions of their opposite panel for guiding the assembly of, and the positions of, the panels relative to each other. Detents are provided for holding the panels in their transverse position for marker use or, alternatively, in their folded, parallel storage position. The upper ends of the panels are provided with seats for mounting signaling devices, such as lights and the like. A ring-like, removable base may be provided to encircle the lower end of the transversely arranged panels for stabilizing and supporting the lower ends of the panels upon a road surface.

16 Claims, 4 Drawing Sheets

FIG-5
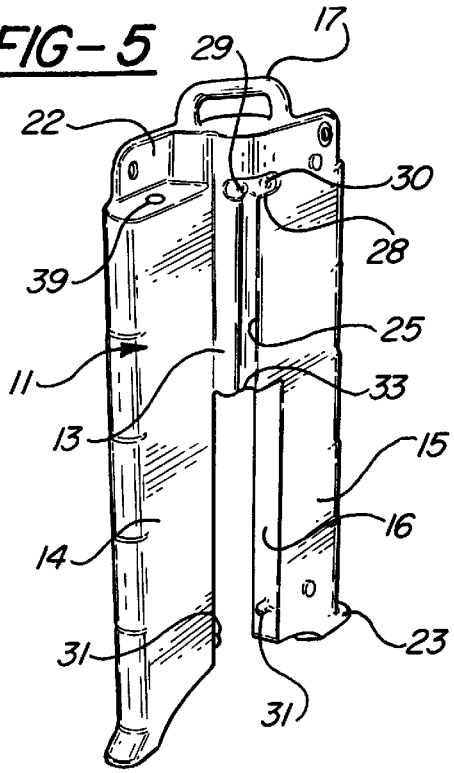
FIG-7
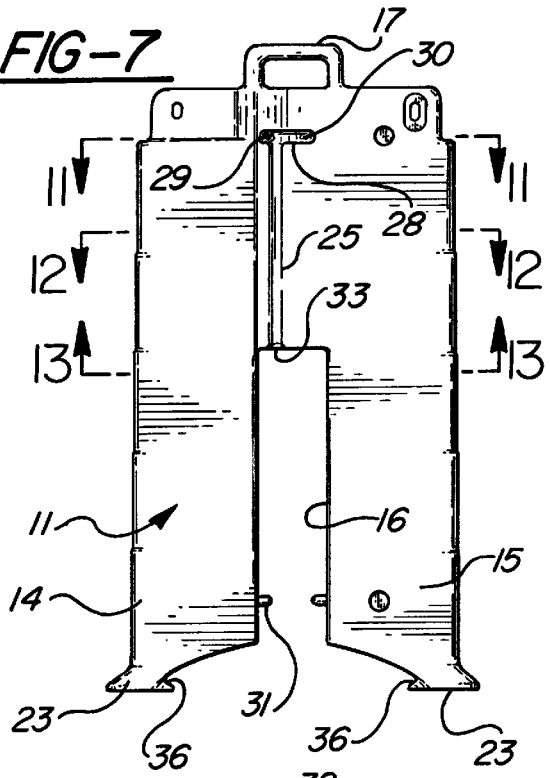
FIG-8
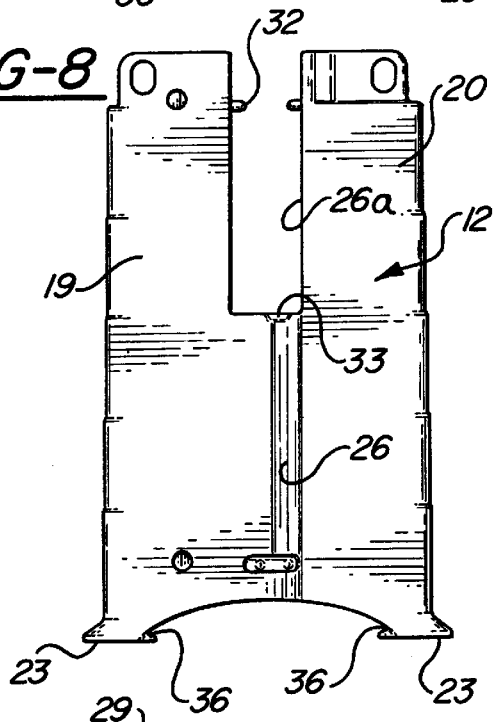
FIG-6
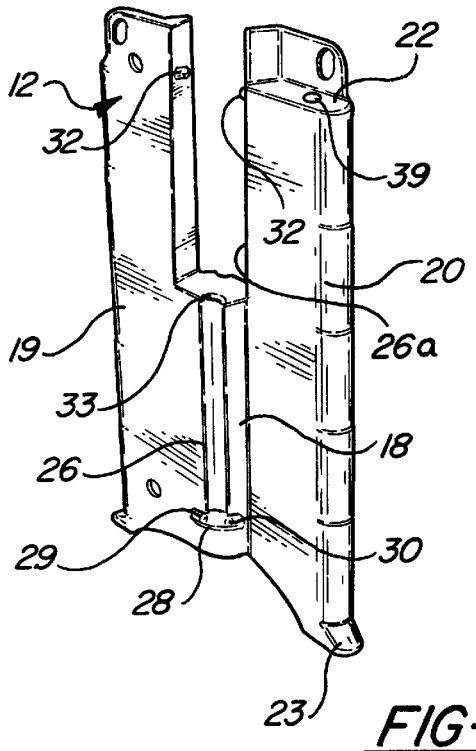
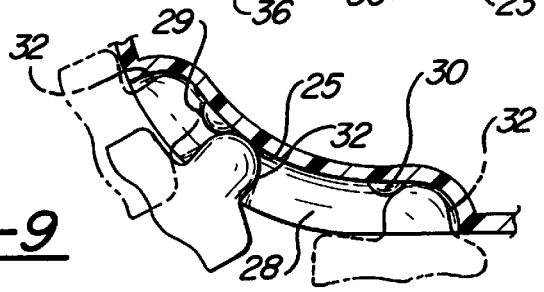
FIG-9

FIG-14
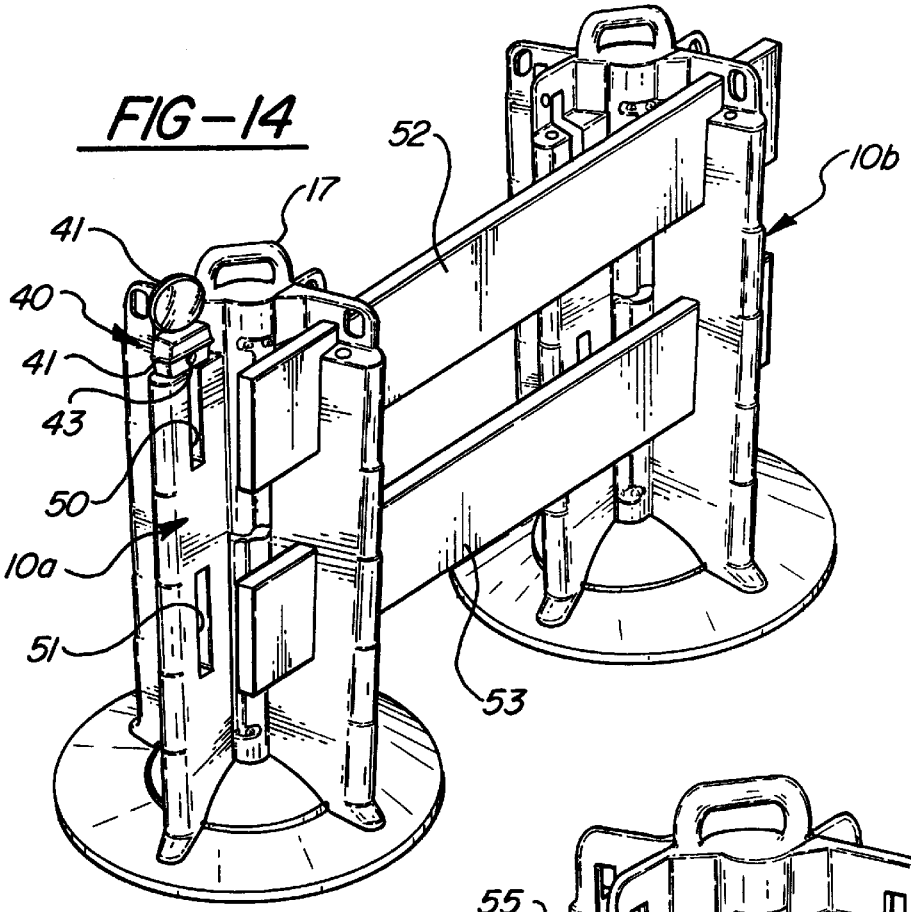
FIG-15
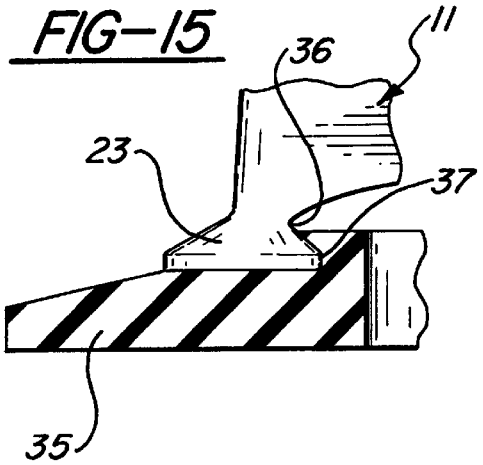
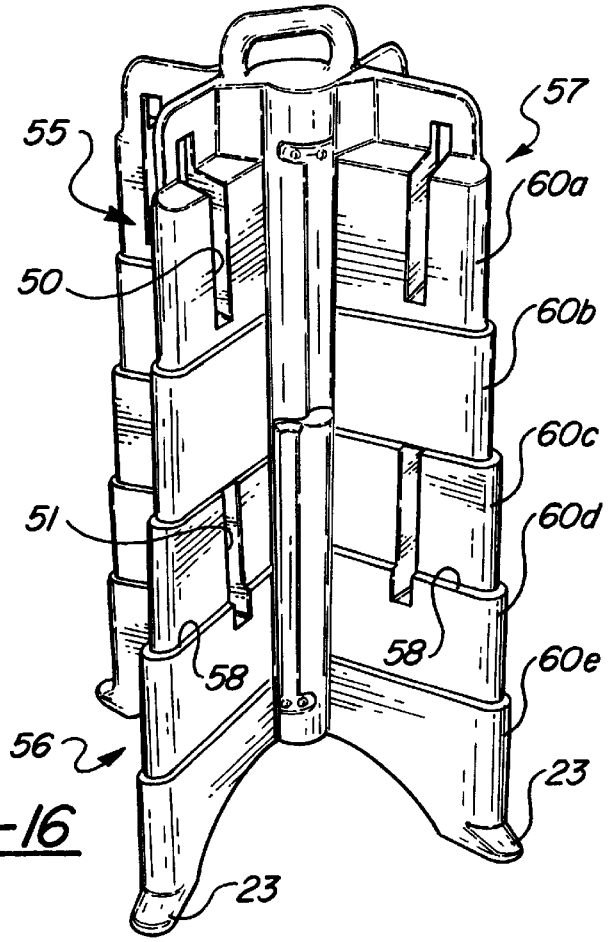
FIG-16

FOLDABLE ROAD MARKER

BACKGROUND OF INVENTION

This invention relates to a road marker which can be placed temporarily upon a road for directing traffic or placed upon the ground for marking off areas. This road marker may be manually assembled for use as a barrier or guide or, alternatively, may be folded flat for transportation or storage.

Road markers are conventionally used along roads and other geographic areas for visually marking the areas. For example, in construction zones along a road, markers are positioned for visually guiding vehicle drivers for passage around marked-off areas. Other examples are the placement of markers at geographical areas for guiding the parking of vehicles or for temporarily blocking off areas to vehicles or people.

One conventional road marker comprises a barrel which may be formed of a plastic material. Such barrels are typically brightly colored so that they are readily visible. A large number of such barrels may be aligned on a highway to mark off of a lane of highway, that is, to guide vehicles around the marked off lane or other portion of the highway during construction work. In addition, it is common to mount upon the upper ends of the barrels battery operated lights or similar attention getting devices.

Another form of commonly used marker comprises cone shaped, rubber-like plastic devices. These may be aligned in spaced apart relationship along a road or other geographic area to mark off a section that is temporarily off limits to vehicles or pedestrians or to guide traffic.

Other types of road markers, such as so-called horses or barricades made of inverted, spaced apart V-shaped ends between which an elongated board is positioned, are used to block off an area, as for example, a parade route or other gathering, which is temporarily off limits to the public.

Conventional road markers or barriers are bulky requiring considerable space for storage and transportation, and relatively expensive. Thus, large numbers of the commonly used large barrels and cones are relatively difficult to transport to use sites. Ordinary metal barrels that are also commonly used require considerable space on delivery trucks. Barrels and cones molded out of plastic are tapered to telescopically fit within one another other. Still the amount of space required on a truck to carry a large number of these barrels is substantial. Thus, the transportation of a large number of such plastic barrels or cones, as for example, to a road construction project, requires a number of truck loads and a considerable amount of manual labor for transporting the barrels.

Thus, it would be desirable to provide road markers or barriers which may be easily folded to minimize their bulk during transportation and storage, but which may be manually assembled into a bulky use condition without tools and with minimal labor. Since road markers are typically used in large numbers, it is important to have barriers that are of minimal expense and, in addition, which may be easily repaired when damaged, such as upon being hit by a vehicle, to reduce the cost of such markers.

SUMMARY OF INVENTION

This invention relates to a road barrier or marker which comprises a pair of interconnected panels that may be arranged upright, transversely to each other, to provide a bulky, visible road marker and, alternatively, the panels can be manually folded into a flat position in which the panels overlap and are generally parallel. The folded position reduces the volume of the marker so that a number of the markers can be stacked and stored or transported in minimal space. When intended for marker use, the folded panels can be manually pivoted relative to each other into their transverse position without tools.

The panels have vertical center portions provided with elongated slots. The slot of one panel receives the center portion of the opposite panel for interconnecting the two panels. In addition, a guide member is formed within the slot of each panel for engaging within a guide channel formed in the center portion of the opposite panel. Detents may be provided to hold the panels in either their transverse or their folded, parallel, positions.

Preferably, the panels are hollow so that they may be at least partially filled with a fluid-like material, such as sand or water or the like, for increasing their weight and stability when desired. Thus, the panels may be of light weight so that they can be easily transported or moved and then weighted with fillers inserted when the markers are used. Also, because the panels are easily assembled and disassembled from each other, in the event of damage, such as caused by vehicle impact, a damaged panel can be easily replaced. In that way, the marker may be inexpensively repaired and used for a relatively long time. Further, the panels may be provided with seats on their upper ends for supporting signaling devices such as commonly used battery powered lights or reflectors.

An object of this invention is to provide a relatively inexpensive, extremely sturdy, easily transported and stored highway marker which is formed of a pair of pivotally interconnected panels that can be manually moved into a criss-cross or transverse marker position or, alternatively, folded into an approximately parallel position for storage and transportation.

Another object of this invention is to provide an easily transportable road marker that can be quickly and easily moved in large quantites to a site requiring such markers and rapidly set up into road marker positions without the use of any tools.

A further object of this invention is to provide a simplified road marker construction which can, when desired, be used to form a barricade by utilizing two or more road markers with wood, plastic or tape strips extending between them.

Still a further object of this invention is to reduce the expense and increase the life of road markers which can be fabricated by plastic molding and whose bulk can be temporarily reduced so that they can be inexpensively transported and stored and then set up with minimal labor.

These and other objects and advantages of this invention will be become apparent upon reading the following description of which the attached drawings for a part.

DESCRIPTION OF DRAWINGS

FIG. 5 is a perspective view of one of the panels of the road marker and

FIG. 6 is a perspective view of the opposite panel of the road marker.

FIG. 7 is a front, elevational view, to a smaller scale, of the panel illustrated in FIG. 5.

FIG. 8 is a front, elevational view, to a smaller scale, of the panel illustrated in FIG. 6. A dotted centerline shown between FIGS. 7 and 8 illustrates the axial alignment of the two panels when ready for assembly.

FIG. 9 is an enlarged, fragmentary view of the guide and detent arrangement of the two panels.

FIG. 14 is a perspective view of a pair of modified markers connected together by planks or boards to form a road barrier.

FIG. 15 is an enlarged, fragmentary view showing the connection between a panel lower support foot and the supporting base or ring.

FIG. 16 is a perspective view of a modification which includes openings for receiving barrier boards or planks (as illustrated in FIG. 14) and, in addition, showing the panels molded in bands or stripes of increasing size, from top to bottom of the panels.

DETAILED DESCRIPTION

Figure 1:
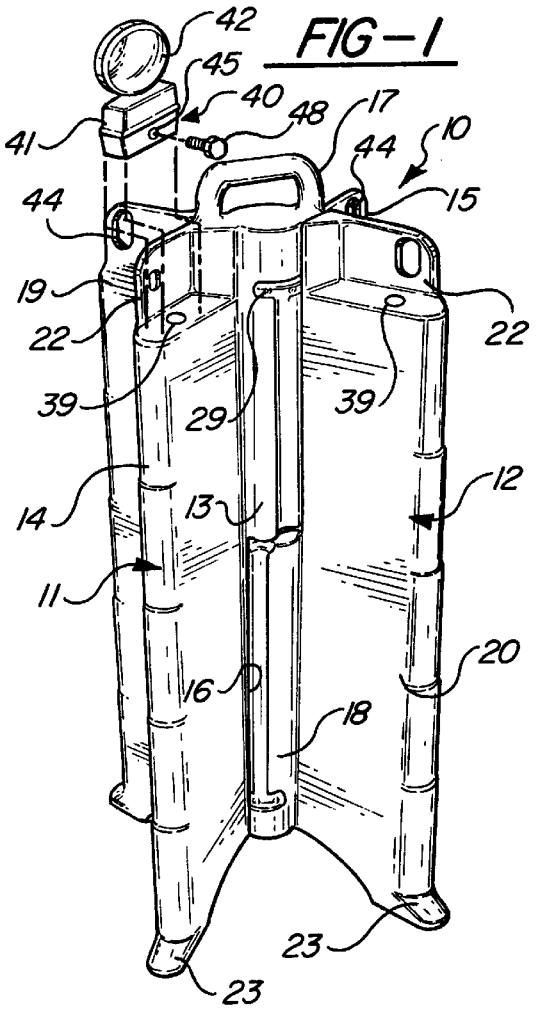
FIG. 1 is a perspective view of the road marker in use position with a signal light arranged for assembly to the upper end of one of the panels of the marker.

FIG. 1 illustrates the road marker 10 arranged in its upright, use position standing on a ground surface. The marker comprises two panels 11 and 12 which are similar in construction. Panel 11 has a central spine or column 13 that extends from the upper edge of the panel to a point about halfway towards the lower edge of the panel. Integrally joined to the column are oppositely extending side wing portions 14 and 15. These side portions are arranged in parallel, but laterally offset planes.

The arrangement of the spine or column provides a vertically extending slot 16 between the side wing portions. The slot 16 extends from the lower edge of the panel 11 upwardly to the point where the column begins. In addition, the upper edge of the panel may be provided with a suitable handle 17 for manually grasping and moving the marker when desired.

Panel 12 is similar in construction to panel 11. However, the center spine or column 18 extends from the lower edge of the panel 12 upwardly to a point located at about the middle of the panel. The panel includes side wing portions 19 and 20 which are substantially parallel, but offset from each other relative to the central axis of the panel.

Each panel is provided with an indented or depressed upper seat 22 or socket which, as will be described below, serves for positioning and securing a signal device. The lower end of each panel is provided with feet 23 upon which the panels rest when in upright, use position.

The two panels are pivotly interconnected by aligning them, as indicated by FIGS. 7 and 8, and then sliding them towards each other. Thus, the center spine or column of one panel slidably fits into the elongated slot of the other panel. In order to maintain the alignment and positions of the panels relative to each other, a detent and guide system is provided. This system includes a pair of vertical guide channels 25 which receive guide knobs for guiding the panels when they are slidably assembled relative to each other. Thus, a vertical guide channel 25 is formed on each side of each of the center spine 13 of panel 11. (See FIGS. 12 and 13). Similarly, vertical guide channels 26*a* are formed in the center spine 18 of panel 12.

The guide channels extend part-way towards the upper edge and lower edge of the respective panels (see FIGS. 7 and 8). At the point where the channels end, cross channels 28 are formed. These cross channels include a pair of detent bumps 29 and 30 (see FIG. 9).

Each of the panels, within their slots 16 and 26, is provided with guide knobs or protuberances 31 and 32, respectively. The guide knobs 31 formed in the slot 16 of panel 11 slidably fit within the vertical guide channels 25 in panel 12. Similarly, the guide knobs 32 formed in the slot 26 of panel 12 slideably fit within the vertical guide channels 25 in panel 11. In order to facilitate the guide knobs entering into the their respective channels, the free ends of the channels are provided with a flared or widened mouth 33. Thus, when the two panels are aligned along their central axes and then slid toward each other, their respective knobs are guided into and then slide longitudely within the particular vertical guide channels in which they are inserted.

Figure 3:
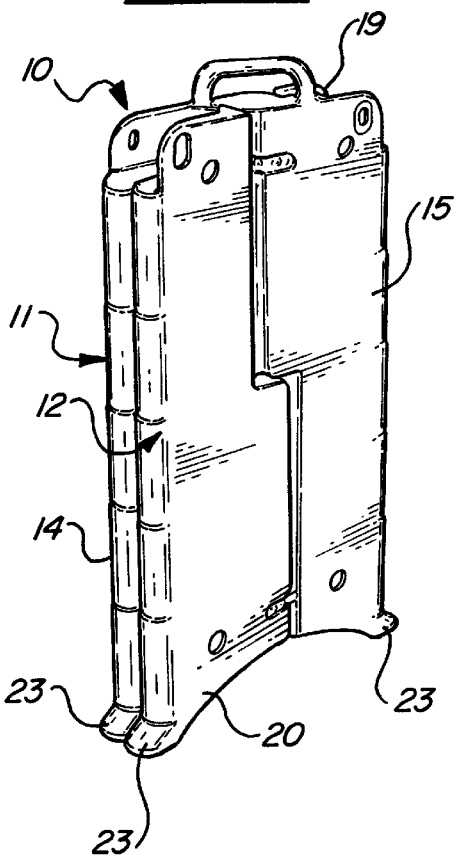
FIG. 3 is a perspective illustration of the road marker with its panels folded for compacting the device for storage or transportation.
Figure 2:
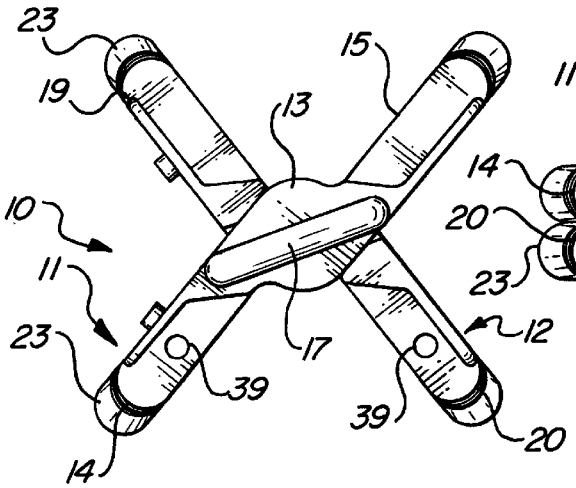
FIG. 2 is a top, plan view, that is looking downwardly at the marker.
Figure 4:
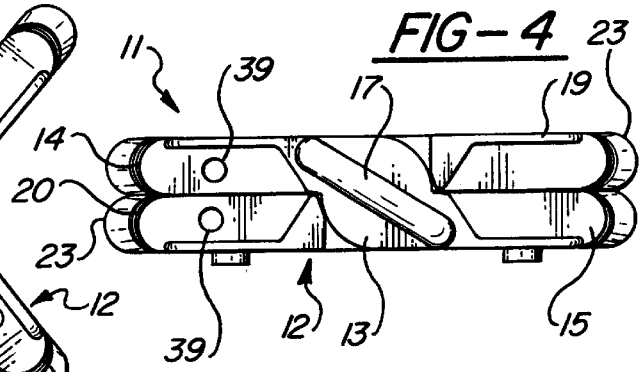
FIG. 4 is a top, plan view of the folded marker of FIG. 3.

When the guide knobs reach the cross channels 28, the panels may be manually turned relative to each other into the use position shown in FIG. 1 where the panels are approximately perpendicular to each other. Alternatively, the panels may be turned into a parallel position, as shown in FIG. 3, where they are approximately parallel and in face to face contact. In either case, the guide knobs move within the cross channels and are forced to resiliently pass over the respective detent bumps 29 or 30. The bumps hold the knobs, and correspondingly their respective panels, in either the transverse or parallel positions of FIGS. 1 or 3.

To support the marker against being tipped over by strong winds or by heavy air currents resulting from the passage of vehicles, a base support ring 35 may be provided. Preferably, the support ring is a rubber-like ring which encircles the panels and is engaged with the panel feet 23. For that purpose, the feet may be provided with indentations 36 (see FIGS. 7, 8 and 15) which engage within groves 37 (see FIG. 15) of the rubber-like support ring. Thus, the ring may be pulled off the feet or may be resiliently distorted sufficiently to engage with the feet, as desired.

The markers may be of varying height. For example, for use in channeling or directing traffic on a highway by blocking off a lane of traffic, the markers may be made of a height of about one meter. Alternatively, a smaller marker for indicating that an area is blocked may be on the order of a third of a meter in height. The particular height may be varied depending upon the intended use of the markers.

Figure 11:
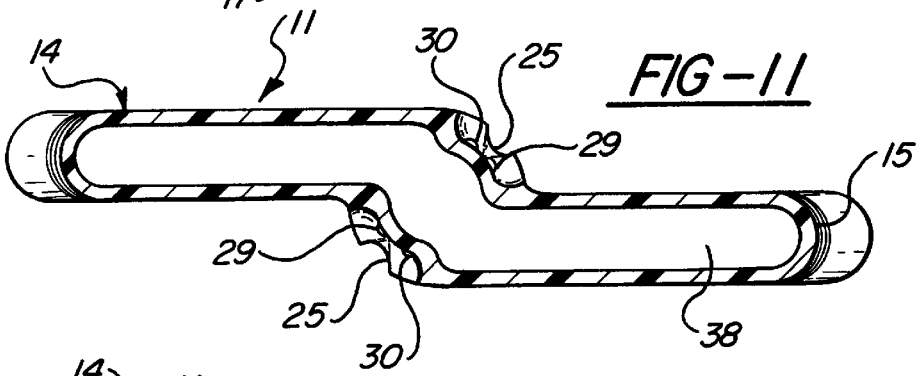
FIG. 11 is an enlarged, cross-sectional view taken in the direction of arrows 11—11 of FIG. 7.
Figure 12:
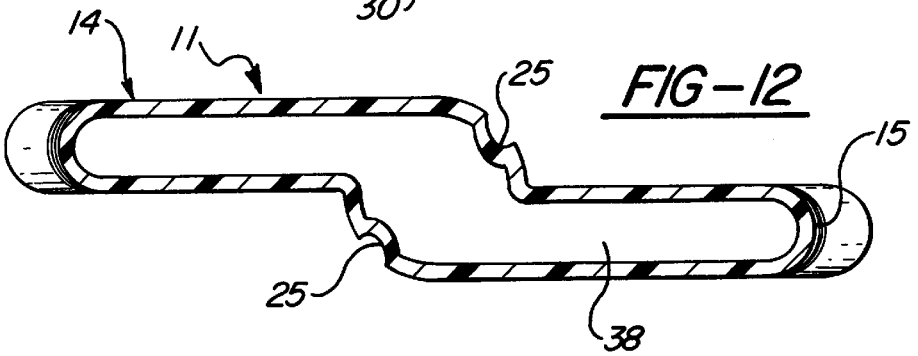
FIG. 12 is an enlarged cross-sectional view taken in the direction of arrows 12—12 of FIG. 7.
Figure 13:
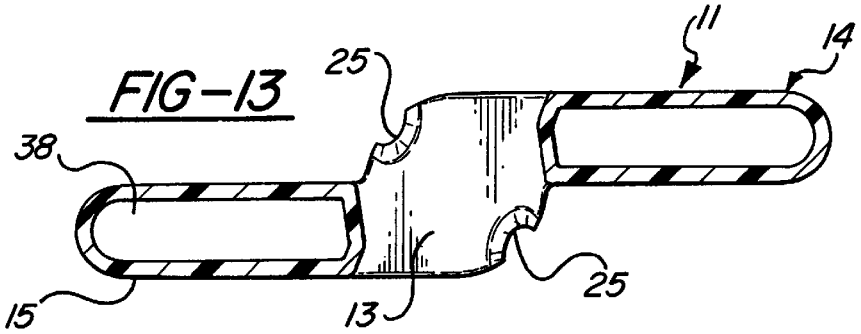
FIG. 13 is a cross-sectional view taken in direction of arrows 13—13 of FIG. 7.

Because of their size, it is preferable to form the panels with hollow interiors 38 (see FIGS. 11–13). That reduces the weight and the amount of plastic needed for molding the panels out of suitable plastic material. However, for some uses, it may be desired to increase the weight of the markers, particularly at their lower ends for stabilizing them in position and from tipping over. For that purpose, openings 39 (see FIG. 1) may be formed in the upper ends of the panels. Caps or plugs (not shown) may be removably applied to the openings. A liquid or fluid-like material, such as water or sand, or fine gravel, may be inserted through the openings in sufficient quantity to add weight and density to the marker. Typically, the added material or filling would be applied to height of less than the full height of the panels, as for example, less than one third of a meter, so that the upper portions of a one meter high marker remain unfilled. Thus, the panels would be sufficiently flexible to be able to resiliently bend so as to resist damage due to impacts.

The panels may be molded out of a plastic material which is sufficiently durable for the intended purpose. Those skilled in the molding art would be able to select a suitable commercially available material.

Figure 10:
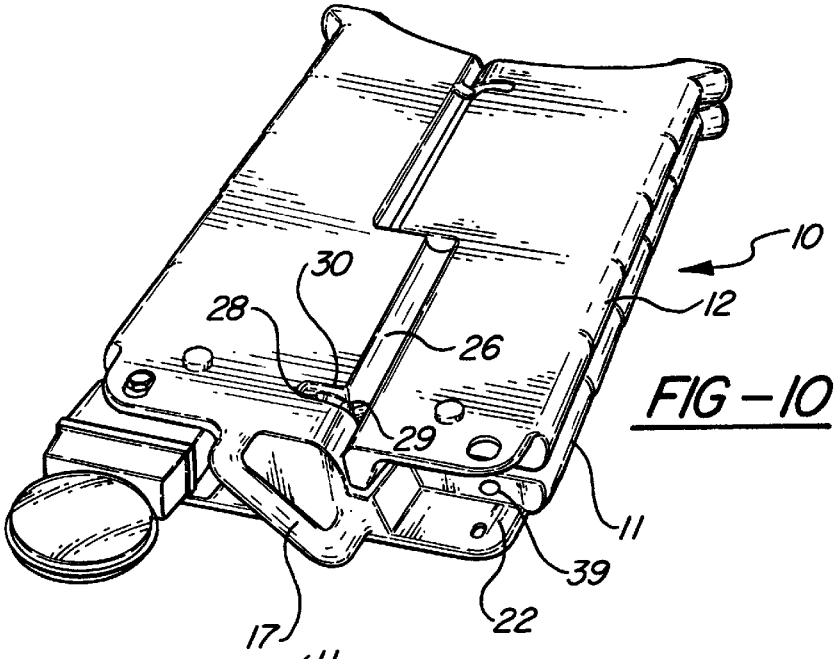
FIG. 10 is a perspective view of the marker in folded condition lying horizontally for stacking upon other folded markers for storage or transportation.

As indicated in FIGS. 1 and 10, a conventional signal device 40 may be secured within one of the upper seats 22 of the panels. By way of illustration, a signal device 40 having a battery container 41, which includes a conventional light sensitive or a timer switch, supports and energizes a lamp 42. The signal device may be fastened within the seat by means of a suitable fastener 43, such as a screw, inserted through a hole 44 in the panel and a hole 45 in the signal device casing 41. Thus, the signal device can be replaced whenever desired either to replace worn batteries or to replace a damaged signal device. Other forms of signal devices commonly used in highway road markers can be utilized for the same purpose and mounted in the same way as indicated above.

FIG. 14 illustrates a modification wherein a pair of spaced apart road markers 10*a* and 10*b* are provided with vertically elongated openings 50 and 51 in each of their side wing portions. Elongated strips, such as wood or plastic planks or boards 52 and 53 are extended between the pair of markers. The strips have their ends inserted through the openings in the spaced apart road markers as shown in FIG. 14. With that construction, a pair of spaced apart road markers connected by one or more boards or planks form a barrier which may be placed across a road or other area to prevent entry into that area. As an alternative, a suitable flexible tape or a conventional foraminous or mesh elongated sheet of plastic could be attached at its opposite ends to the spaced apart markers for creating the barrier effect.

FIG. 16 illustrates a second modification, wherein the side marker 55 has panels 56 and 57 whose side or wing portions are formed with molded bands or stripes 60*a*–60*f*. Each successive stripe is slightly larger than the stripe located above it. The separate strips may be easily colored with paint or dye or colored tape, to present a colorful, attention getting appearance. For example, the successive stripes may be alternately colored yellow and black or orange and white to provide a bright, striped visual appearance. In addition, the varying size stripes increase the lateral strength of the hollow panels since their lateral integral edges 58, create a series of ribs which rigidify the walls of the hollow panels. The stripe forming sections may be varied in number and width. For example, six stripe sections are illustrated in FIG. 16 (see 60*a–g,*). The panels are otherwise constructed in the same way as described above. However, they are illustrated as including openings 50 and 51 for receiving the barrier forming planks in a manner similar to the barrier arrangement shown in FIG. 14.

In operation, the two panels 11 and 12 which form the marker, are manually assembled by aligning their axes and then sliding them towards each other. Thus, the center column of each panel fits into the slot of the opposite panel. The knobs of each panel enter, through the flared ends, the vertically elongated channels of the opposite panel center portion for guiding the panels as they are slid together. Then, when the panels reach their final position, that is, where the inner ends of their respective columns abut, the knobs are moved into the cross channels by rotating the panels relative to each other. If the panels are rotated in one direction, they are arranged in a parallel, overlapping position, as shown in FIGS. 3 and 10. The panels may then be arranged in parallel position, as shown in FIGS. 3 and 10. During the rotation, the knobs will be manually forced over one set of detent bumps 29. That holds the panels in the folded or parallel position where a number of markers may be stacked horizontally, one upon another, or vertically with one next to another for storage and transportation.

If the panels are rotated in the opposite direction, where the knobs are manually forced over the detent bumps 30, the pair of panels are held approximately perpendicular relative to each other as shown in FIG. 1. In that position, the marker is ready for use.

Where desired, signal devices such as lamps, can be mounted within one of the seats 22 formed on each of the markers (as shown in FIG. 10) when the markers are stored or before they are transported to a site. Thus, when the markers are set up in use position, the signal devices are in place ready for use. When the markers are no longer needed for a particular site, a workman manually rotates the panels relative to each other until the panels are in their folded or flat, face to face, and position transported elsewhere with their signal devices. The folded panels, utilize so much less space than when the markers are set up for use, that, a considerable number of markers can be stacked and transported upon a truck or stored in a warehouse.

The foregoing should be read as a description of preferred, operative embodiments of this invention and not in a strictly limiting sense. This invention may be further developed within the scope of the following claims. Thus, having fully described an operative embodiment of this invention, we now claim.

What is claimed is:

1. A foldable road marker comprising:

a pair of normally vertical upright panels, which each panel formed with a pair of vertically arranged, oppositely extending side portions having adjacent edges integrally joined together by a central column portion;

the panels having upper and lower edges with the column portion of the first panel extending from an upper edge of that panel part-way towards a lower edge and the column portion of the second panel extending part-way from a lower edge of the panel towards an upper edge of the panel to provide central slots in the panels;

the column portions of each panel and the slots in each panel being substantially co-axially aligned and with the column portion of each first and second panel being fitted within the slot of the first and second panel so that the two panels are interconnected and may be pivoted about said column portions into a marker use position with side portions of the first panel being arranged transversely relative to side portions of the second panel or the panels may be turned about said column portions relative to each other into a folded storage position for storage or transportation; wherein adjacent side portions of the panels are substantially parallel to and overlap each other.

2. A foldable road marker as defined in claim 1 and including one slot opening upwardly at the upper edge of its respective column and the other slot opening downwardly at the lower edge of its respective column so that the panels may be assembled together by manually coaxially aligning and moving the column portions towards each other so that each column portion is fitted into the slot of the other panel and the panels may be disassembled by moving the panels apart.

3. A foldable road marker as defined in claim 1 and the side portions of each panel being generally parallel to each other, but offset laterally, in opposite directions relative to a central axis of the column to which such panels are joined;

whereby the adjacent side portions of the panels are adjacent one another when the panels are pivoted into folded non-use position.

4. A foldable road marker as defined in claim 3 and including vertically elongated channels formed in each of the column portions and including detents formed adjacent the ends of the column portions, adjacent such channels, and corresponding detent associated members formed in the slots of the panels so that such detent associated members engage the detents when the panels are either arranged with their side portions transversely to each other or adjacent each other for holding the panels in said positions until manually moved therefrom.

5. A foldable road marker as defined in claim 4 and including said detent associated members being arranged to normally slide along the respective adjacent column channels for guiding the panels during manually sliding the columns of each into the slots of the panel.

6. A foldable road marker as defined in claim 5 and including each column channel having a transverse channel formed therein, within which said detents are located for engaging and guiding the detent associated members from the column channels into detent engaging positions.

7. A foldable road marker as defined in claim 1 and including openings formed in the panel side portions, with openings being of a size to receive end portions of generally horizontally arranged barrier strips whose opposite ends are supported by two spaced apart, foldable road markers.

8. A foldable road marker as defined in claim 1 and including support legs formed on the lower ends of each of the panels for supporting the panels upright on a support surface.

9. A foldable road marker as defined in claim 8 and including a separate support base, having a ring shape, arranged around a periphery of the lower ends of the panels and said legs of the panels and detachably connected to said legs for supporting and maintaining the upright positions of the panels.

10. A foldable road marker as defined in claim 1 and including each of said panels being hollow; and flowable material, partially filling the panels from their lower edges at least partway upwardly towards their upper edges.

11. A foldable road marker comprising a pair of generally flat panels each having a central, normally vertically upright, stem portion integrally joined to oppositely extending panel side portions;

vertically elongated slots formed in the stem portions of each panel, with one slot extending from an upper end to approximately the panel middle and the opposite slot extending from the lower end to approximately the panel middle;

the two panels being assembled together with the stem portion of each panel arranged in co-axial alignment, within the slot of the other panel so that the stem portions and the slots are co-axially aligned along a generally vertical axis;

the two panels being normally arranged transversely of each other for use position of the marker and, alternatively, being manually pivotable about said axis with their respective side portions overlapping and being adjacent each other for folding the marker into a storage or non-use position.

12. A foldable road marker as defined in claim 11 and including each panel having a guide member inserted within, and being vertically moveable within, a guide channel formed in the stem portion of an opposite panel.

13. A foldable road marker as defined in claim 12 and including detents formed in the stem portions of each panel for engaging and holding the guide member of the opposite panel in either a panel transverse marker use position or in a marker folded positions for storage.

14. A foldable road collapsible road barrier as defined in claim 13 and including said panels each having leg members formed on the lower ends of the panels for supporting the panels in an upright position upon a surface;

and a base formed in the shape of a ring surrounding the lower ends of the panels when the panels are arranged transversely of each other; with the ring being releasable connected to the legs for supporting and balancing the marker in an upright position.

15. A collapsible road marker as defined in claim 13 and including seats formed on the upper ends of at least some of the panel side members with said seats being of a size and shape for holding and supporting a removable signal device.

16. A foldable road marker as defined in claim 13 and including openings formed in at least some of the panel side portions;

wherein horizontally elongated strips may be inserted within said openings for supporting the strips in positions to act as a barrier between a pair of spaced apart road markers constructed substantially identically.

* * * * *